US005887413A

United States Patent [19]

Rowley et al.

[11] Patent Number: 5,887,413

[45] Date of Patent: Mar. 30, 1999

[54] SOLID PACK FISH CANNING MACHINE

[75] Inventors: Edward J. Rowley, Azusa; Jack Gorby, Los Angeles, both of Calif.

[73] Assignee: Luthi Machinery & Engineering Co., Inc., Gardena, Calif.

[21] Appl. No.: 905,575

[22] Filed: Aug. 4, 1997

[51] Int. Cl.[6] ..... B65B 3/32; B65B 59/00; B65B 63/02

[52] U.S. Cl. ..... 53/517; 53/201; 53/252; 53/257; 426/518

[58] Field of Search ..... 53/517, 514, 513, 53/252, 251, 201, 257, 435; 99/537; 426/518, 513, 397, 407; 100/218

[56] References Cited

U.S. PATENT DOCUMENTS

| | | | |
|---|---|---|---|
| 2,037,724 | 4/1936 | Jacobs et al. | 226/101 |
| 2,542,133 | 2/1951 | Gorby | 99/188 |
| 2,926,095 | 2/1960 | Gorby | 99/188 |
| 3,026,660 | 3/1962 | Luthi et al. | 53/124 |
| 3,123,958 | 3/1964 | Carruthers | 53/517 |
| 3,179,041 | 4/1965 | Luthi et al. | 100/223 |
| 3,181,957 | 5/1965 | Carruthers | 53/517 X |
| 3,213,901 | 10/1965 | Luthi et al. | 141/12 |
| 3,700,386 | 10/1972 | Mencacci | 53/123 |
| 4,116,600 | 9/1978 | Dutton et al. | 425/296 |
| 4,166,140 | 8/1979 | Dutton et al. | 426/397 |
| 5,199,241 | 4/1993 | Gorby et al. | 53/122 |
| 5,203,141 | 4/1993 | Berciga et al. | 53/435 |

*Primary Examiner*—James F. Coan
*Attorney, Agent, or Firm*—Lyon & Lyon LLP

[57] ABSTRACT

A fish-canning machine having two adjacent parallel rotary turrets each having fish-receiving forming pockets in the periphery thereof. The turrets are positioned to align two of the pockets with each other to form a single combined pocket which is then filled with fish from a corresponding large size feed chute of increasing cross-sectional area. The fish in the pockets is severed between the turrets and the turrets are rotated by different amounts to move the filled pockets laterally out of alignment with each other. The fish in both filled pockets is formed into the shape of a can and ejected endwise from the pockets into two separate cans. Spaces between the turrets and the housing provide for plate inserts and variation in the thickness of the forming elements so as to accommodate a variety of pack sizes and characteristics. The plate inserts include studs which extend through the housing with attachment spacers to engage attachment bars. Various spacer sizes provide adjustment to the positions of the plate inserts. Shims may also be used to position the plate inserts. Forming pocket guides and forming shoes are associated with the turrets which extend beyond the turret plate widths to define, with the immediately adjacent plate inserts, the forming pockets.

21 Claims, 18 Drawing Sheets

SOLID PACK FISH CANNING MACHINE

BACKGROUND OF THE INVENTION

The field of the present invention is fish-canning machines and particularly turret type solid pack machines.

Turret type solid pack fish canning equipment has long been available for the canning of substantially whole pieces of fish such as tuna. Reference is made to U.S. Pat. No. 2,542,133, the disclosure of which is incorporated herein by reference. More recently, such devices have included double turret arrangements to increase the speed and quality of pack per machine. Such a machine is disclosed in U.S. Pat. No. 4,116,600, the disclosure of which is incorporated herein by reference. Such double turret machines are widely used around the world for the canning of tuna in a solid pack.

The world market for canned solid pack fish has grown more divergent in terms of pack characteristics. A wide variety of can sizes is now common and the density of the pack for particular markets also varies. Meeting the demands of the commercial market today requires the frequent reconfiguration of equipment to accommodate the various pack requirements.

Characteristic of solid pack fish canning equipment is its close tolerances around the cutting blades and at part lines across which the product is transported during the packing operation. These mechanical requirements are necessary to keep fragmentation of solid pieces and a loss of product from the pack to a minimum. With such stringent mechanical requirements, adjustments to the equipment to accommodate changes in the desired pack have been difficult. Further, the effective thickness of the turret defines the size of the cake; and, for certain changes, the turrets must be taken out and replaced. Such a task is time consuming and requires substantial skill to insure that proper tolerances were again achieved. As greater variety in pack characteristics has become a commercial reality, the inability to rapidly adjust the equipment to meet such demands has been disadvantageous.

SUMMARY OF THE INVENTION

The present invention is directed to an apparatus for forming a product to be introduced into a can. The apparatus is of particular value in the canning of fish. A turret having a forming pocket receives the product. The product is formed into a cake and ejected into a can. Through the use of an adjustable plate insert spaced from the turret, the height of the cake may be determined. Use of adjustable plate inserts can provide for flexibility in defining the size of the cake. This allows for adjustments in the nature of the pack.

In a first, separate aspect of the present invention, a canning apparatus includes a turret plate having a product forming pocket. An adjustable plate insert is provided adjacent the turret. The plate insert defines the apparent turret thickness.

In a second, separate aspect of the present invention, the first aspect is further defined by forming pocket guides which extend from the turret plate to immediately adjacent the plate insert. A close tolerance between the extended forming pocket and the plate insert is thus possible to enhance closure of the pocket.

In a third, separate aspect of the present invention, the first aspect is further defined by forming shoes which move radially in the turret plate. The shoes extend from the turret plate to immediately adjacent the plate insert. Again, a close tolerance is possible with the plate insert to better define the pocket.

In a fourth, separate aspect of the present invention, the first aspect is further defined by an attachment which includes threaded attachment elements fixed to the plate insert that extend from one side of the plate. Attachment spacers are positioned about the threaded attachment elements and the threaded attachment elements are fixable to the housing with the plate insert displaced by the spacers. Selection of the spacers positions the plate insert to define the product cake.

In a fifth, separate aspect of the present invention, the fourth aspect further includes shims which may be associated with the attachment for small changes and refinement of the spacing tolerances.

In a sixth, separate aspect of the present invention, a double turret with adjustable plate inserts to either side of the axially fixed turrets cooperate with forming pockets to define the size and characteristics of the product cake.

In a further, separate aspect of the present invention, any of the foregoing aspects are contemplated to be combined to added advantage.

Accordingly, it is an object of the present invention to provide an improved canning apparatus having greater flexibility in product cake formation. Other objects and advantages will appear hereinafter.

BRIEF DESCRIPTION OF THE DRAWINGS

In the drawings, forming apart of this application, and in which like parts are designed by like reference numerals through the same.

DESCRIPTION OF THE PREFERRED EMBODIMENT

The machine illustrated in FIGS. 1 through 12 is that described in U.S. Pat. No. 4,116,600 which forms the basis of the present system. For adequate disclosure, this earlier design is presented. FIGS. 13 through 33 illustrate the additions and changes which reflect the current design.

Figure 1:
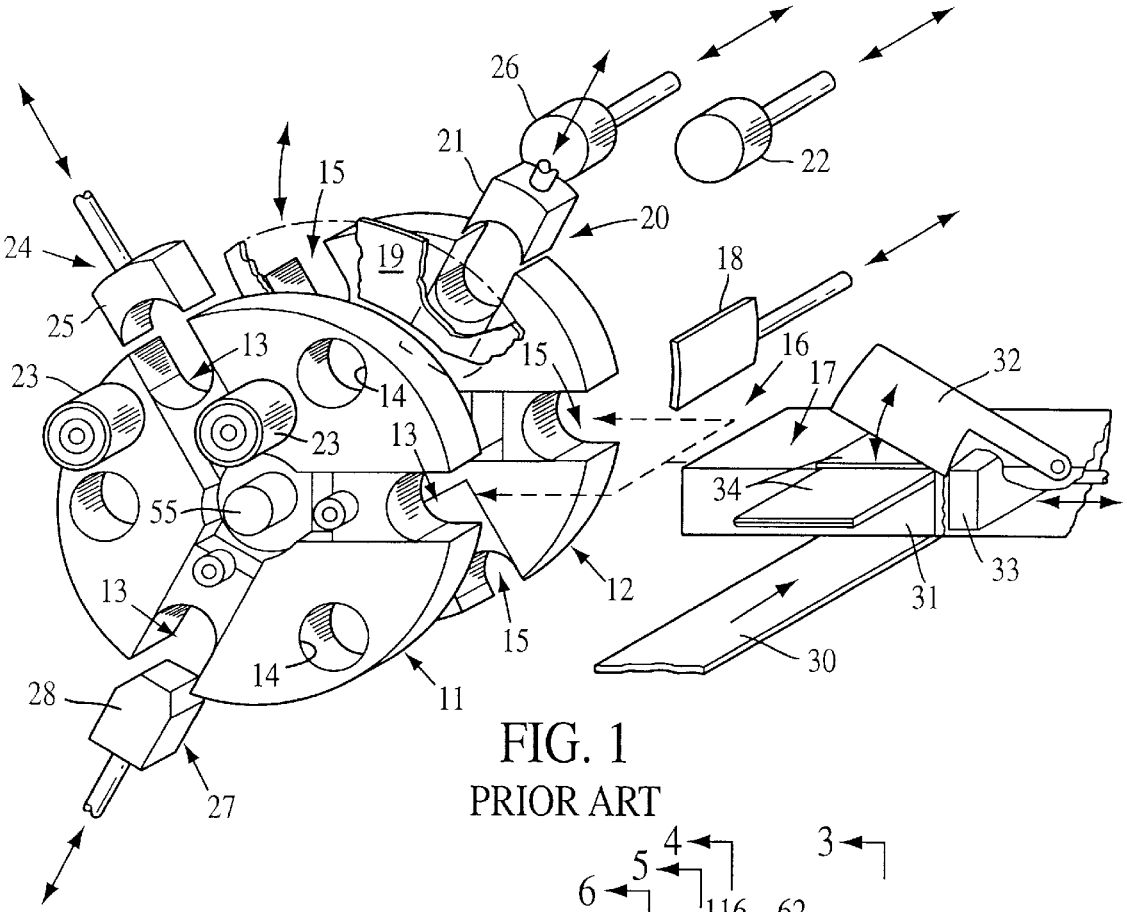
FIG. 1 PRIOR ART
FIG. 1 is a schematic exploded view of the rotatable turrets and the operational stations around the periphery thereof.

Referring to the drawings, and in particular to FIG. 1, a fish-canning machine is disclosed which includes a pair of rotatable turrets 11 and 12 mounted for rotation about a common axis. The turret 11 has three fish-receiving and forming pockets 13 spaced equidistantly therearound and openings 14 between each pair of adjacent pockets. The turret 12 has six equidistantly spaced fish-receiving and forming pockets 15 around the periphery thereof. When the turrets are positioned as in FIG. 1, every other forming pocket 15 of the turret 12 is in axial alignment with a forming pocket 13 of the turret 11 and each of the other forming pockets 15 of the turret 12 is in axial alignment with one of the openings 14 through the turret 11.

Three operating stations are spaced around the periphery of the turrets. The first or feed station 16 comprises a feed chute 17 and a reciprocating volume knife 18 which moves between the end of the feed chute 17 and the peripheries of the turrets 11, 12. A pivotal divider knife 19 is mounted on an axis parallel to that of the turrets for in-and-out movement between the turrets to sever fish that have been fed into the pockets at the station 16.

A second operating station 20 comprises a forming plunger 21 mounted for reciprocating movement radially of the turret 12 into and out of a forming pocket 15 of the turret 12, and a knock-out plunger 22 mounted for reciprocatory movement along a line parallel to the turret axis and adapted to move axially into and through a forming pocket 15 of the turret 12 and the aligned opening 14 of the turret 11 to eject fish into a can 23 and then move out of the opening 14 and the forming pocket 15.

The third station 24 is similar to the second station and includes a forming plunger 25 of the turret 11 and a knock-out plunger 26 adapted to move through aligned pockets of the turrets to eject fish from a pocket of the turret 11 into another can 23.

If desired, a fourth operating station 27 may be provided, this station comprising a lock plunger 28 movable radially of the turrets into and out of aligned pockets of the turrets thereat for locking the turrets against rotation. This station is necessary only if the indexing drive for the turrets does not itself provide sufficient locking of the turrets in the dwell period between rotation of the turrets from the first station to the second and third stations.

The apparatus further includes a conveyor belt 30 which delivers fish loins to the feed chute 17, the loins entering the chute through the side opening 31 thereof. A loin knife 32 is positioned to move down across the side opening 31 and sever the loins fed into the chute, the loins then being moved down the chute towards the turrets by a ram 33. A vertically movable tamper 34 facilitates entry of fish loins into the feed chute.

Figure 2:
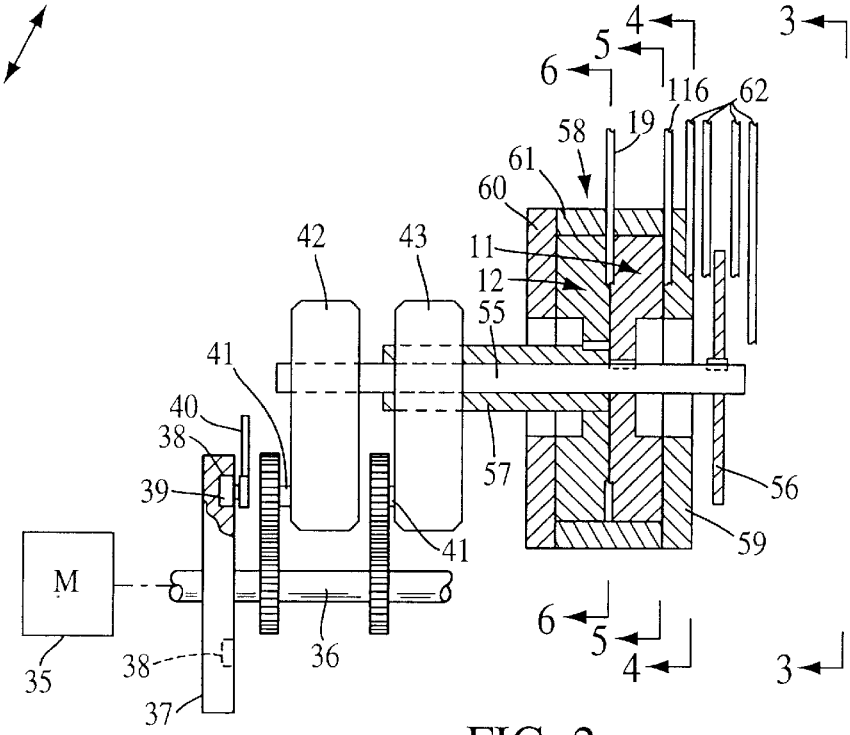
FIG. 2 PRIOR ART
FIG. 2 is a sectional view in elevation of a portion of the machine, illustrating the turrets and drive mechanisms therefor.

Referring now to FIG. 2, the machine includes a motor 35 suitably arranged to drive the main shaft 36 which is conventionally journaled in the frame of the machine for rotation. A positive cam 37, shown in FIG. 2, is illustrative of the various cams which are mounted on the main drive shaft 36 for rotation therewith, the cams being used to actuate the various elements of the machine. The cam 37 has a cam track 38 in the face thereof in which a cam roller 39 rides, the movement of the roller 39 towards and away from the axis of the shaft 36 in turn causing a movement of the cam follower arm 40 on which the roller is mounted.

The shaft 36 is also coupled to the input shafts 41 of the two indexing drive units 42 and 43. The shaft 55 is the output shaft of the indexing drive unit 42 and has a turret 11 and a can star 56 splined thereon. A shaft 57, coaxial and surrounding the shaft 55, is the output of the indexing drive unit 43 and has the turret 12 spline connected thereon. Shafts 55 and 57 are suitably journaled in the frame of the machine for rotation about a fixed and common axis.

The function of the illustrated indexing drive unit 42 is to rotate the output shaft 55 and advance the turret 11 and the can star 56 through two successive 60° increments for each complete revolution of the main shaft 36, such rotation taking place during 180° rotation of shaft 36. The indexing drive unit 43 rotates the output shaft 57 and advances the turret 12 through a single 60° increment for each complete revolution of the shaft 36, such rotation occurring during 90° rotation of the shaft 36. The indexing units hold shafts 55 and 57 at their indexed position during the remaining portions of a single revolution of the shaft 36. The indexing drive units for intermittent stepwise advance, as described above, are commercially available, and are accordingly not described in detail. For example, indexing drive units as used are obtainable from Ferguson Machine Company of St. Louis, Mo.

The turrets 11 and 12 are enclosed by a stationary housing 58, the housing having opposed end plates 59 and 60 adjacent the faces of the turrets. An arcuate wall 61 covers a portion of the peripheries of the turrets, leaving the remainder of the peripheries exposed for cleaning and access. Housing 58 is suitably fixed to the frame of the machine.

Figure 3:
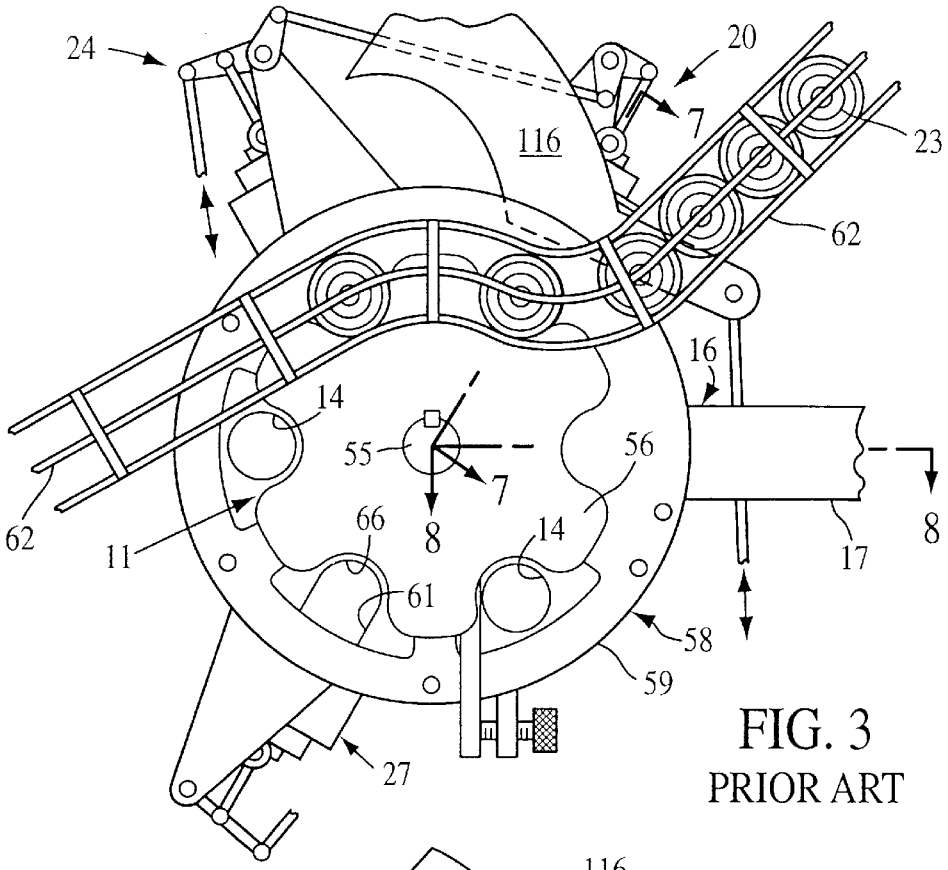
FIG. 3 PRIOR ART
FIG. 3 is a front-elevational view of the turret portion of the machine as seen from line 3—3 of FIG. 2.

Referring now to FIG. 3, a can guide 62 mounted in fixed relation to the machine and housing 58 thereof delivers empty cans 23 to the six-lobed can star 56. The can star operates in a conventional manner to take the empty cans, one-by-one, to carry them around the exterior of the housing plate 59 and then to discharge the cans down the can guide. Since the can star 56 is fixed to the shaft 55, it will rotate in unison with the turret 11 through two 60° increments for each full revolution of the main shaft 36, taking up and discharging a can on each 60° increment of rotation thereof.

Figure 4:
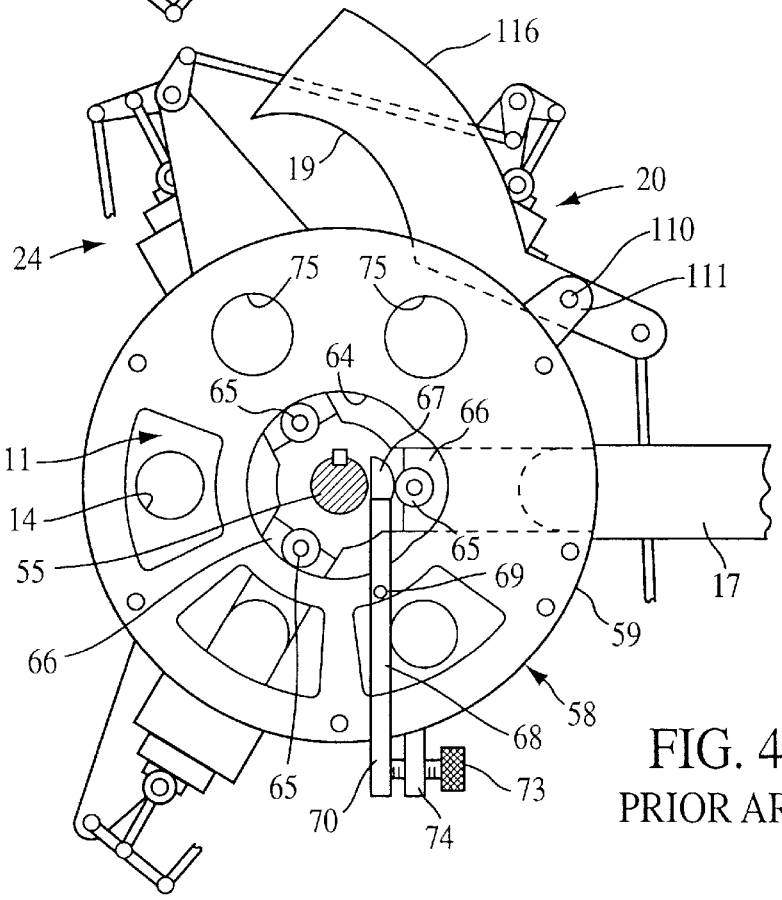
FIG. 4 PRIOR ART
FIGS. 4, 5 and 6 are sectional views similar to FIG. 3 and taken on lines 4—4, 5—5 and 6—6, respectively, of FIG. 2 with drive mechanisms for the various operating stations being shown schematically in FIGS. 5 and 6.

As seen in FIG. 4, the end plate 59 of the housing 58 has a central opening forming a bearing surface 64 for rollers 65 on forming and metering shoes 66 carried by the turret 11. The distance of the bearing surface 64 from the axis of the shaft 55 is constant throughout the length of the bearing surface except at the side thereof adjacent the feed station 16 where the distance is increased. A volume cam 67, positioned to engage the rollers 65, is mounted on a lever arm 68 which is pivotally mounted at a pivot 69 on the housing plate 59. A cross bar 70 on the lower end of lever arm 68 extends to a similar lever arm 71 (FIG. 8) pivotally mounted on the housing plate 60, the latter lever arm having a volume cam 72 on the upper end thereof to engage the rollers on the forming and metering shoes 66 carried by the turret 12. An adjustment screw 73, threaded through housing member 74, bears against cross bar 70 and enables the volume cams 67 and 72 to be positioned simultaneously at a desired distance from the axis of the turrets.

The housing plate 59 is also provided with two circular openings 75 therethrough, each opening having a diameter approximately equal to the can diameter, one opening being at operating station 20 and the other at operating station 24.

The housing plate 60 is the same as the plate 59, having openings and a central roller bearing surface in alignment with the corresponding openings 75 and bearing surface 64 of housing plate 59.

Figure 5:
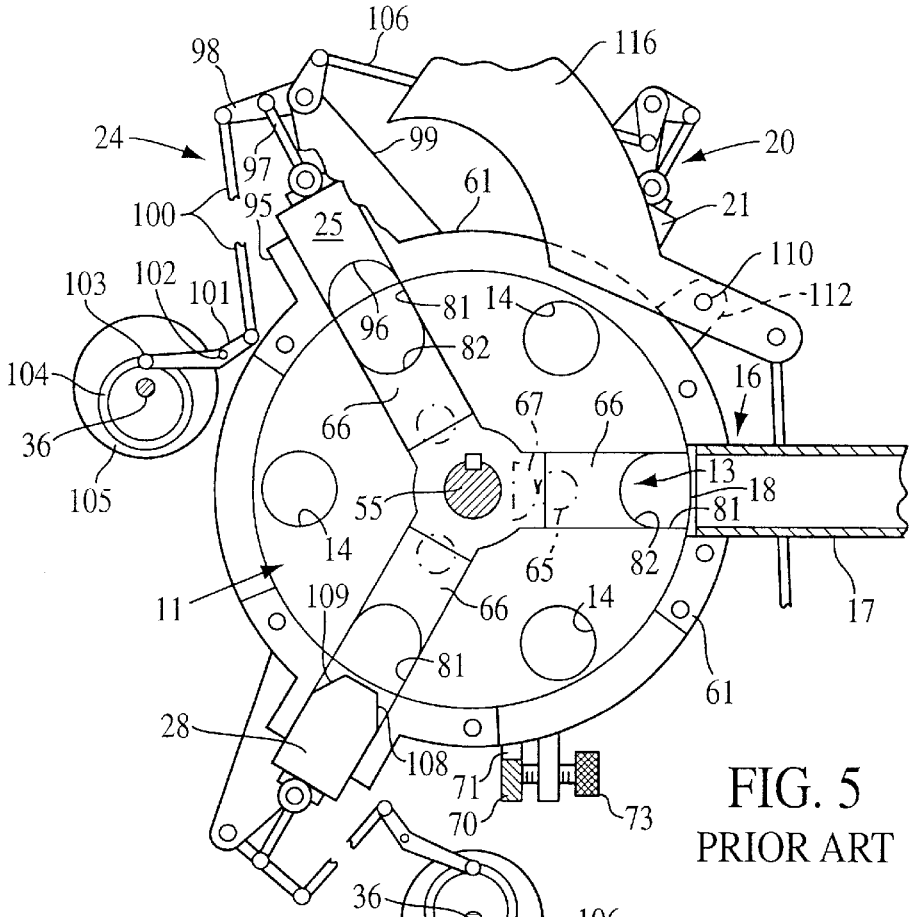
FIG. 5 PRIOR ART
Figure 6:
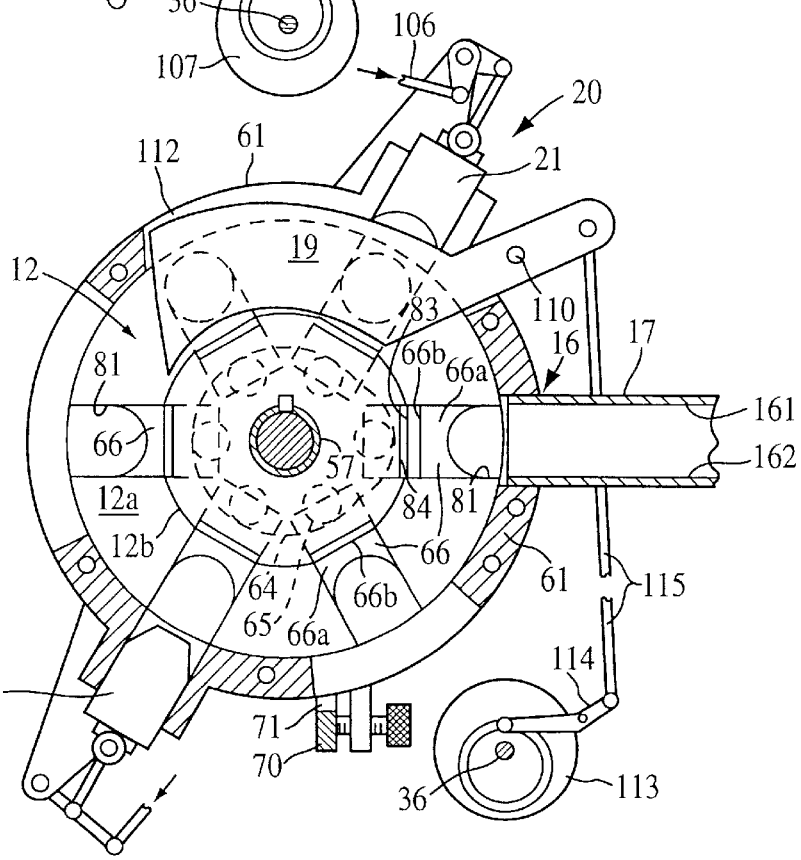
FIG. 6 PRIOR ART

Referring now to FIGS. 5 and 6, the turret 11 has three slots 81 extending radially inwardly from the turret periphery, the slots being spaced equidistantly around the periphery of the turret and forming guideways for the forming and metering shoes 66 which are radially slidable therein. The turret 12 is similarly formed, with six slots for the six forming and metering shoes 66 carried thereby. Each forming and metering shoe 66 has an outer concave end 82 of a curvature slightly less than that of the can 23, and a thickness equal to the thickness of the turret and slightly less than the height of the can 23. Movement of the shoes inwardly toward the axis of the turrets is limited by engagement of the inwardly facing shoulder 83 on the shoe with the outwardly facing step 84 in a slot 81. Thus, as each turret rotates to bring a forming and metering shoe 66 to the feed station 16, the adjustable volume cams 67 and 72 will engage the rollers 65 to force the metering shoes outwardly at a desired distance from the axis of the turrets. As the turrets rotate to move the metering shoes away from the feed station, the rollers 65 will leave the volume cams and engage the bearing surfaces 64 on the housing plates to move the shoes inwardly until they bottom out on the slot steps 84.

Each slot 81 and metering shoe 66 therein forms a pocket 13 in the periphery of the turret 11, the pocket having an axis parallel to the axis of the shaft 55 and a rectangular side opening through the turret periphery, the dimensions of the side opening being slightly less than that of the diameter and height of a can 23.

Figure 8:
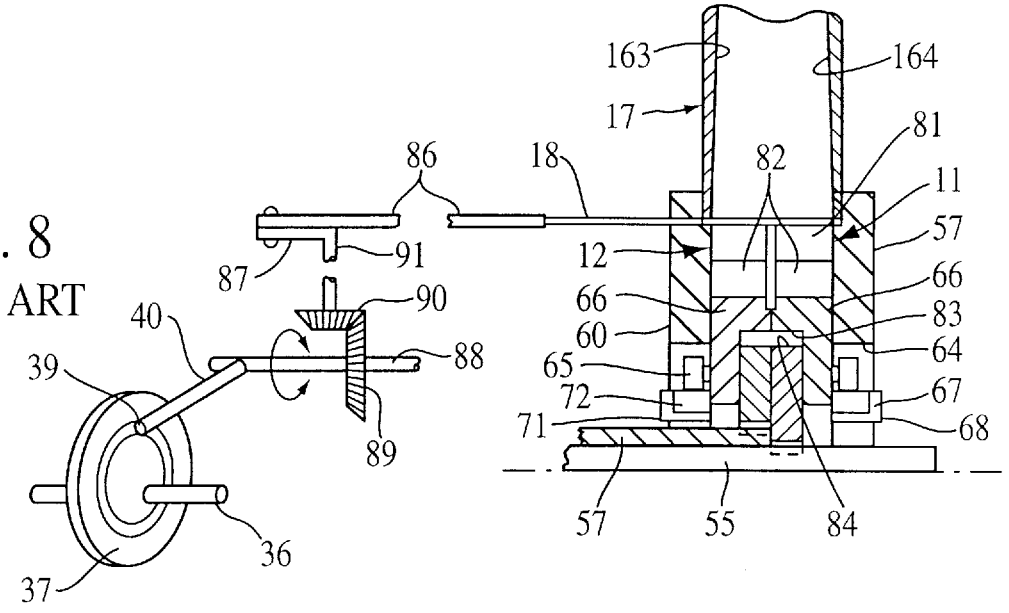
FIG. 8 PRIOR ART
FIG. 8 is a sectional view taken on line 8—8 of FIG. 3, illustrating the volume knife and, schematically, the operating mechanism therefor.

Still with reference to FIG. 5, the feed chute 17 extends through the housing wall 61, with the discharge end of the feed chute being spaced from the turrets sufficiently to allow the volume knife 18 to move therebetween. As shown in FIG. 8 the volume knife, which is mounted in suitable stationary guides (not shown) for reciprocal movement therein, has an actuating arm 86 connected to a crank 87. Rotation of the cam 37 on the main shaft 36 causes a shaft 88 to oscillate about its fixed axis, such movement being transmitted, as for example through bevel gears 89 and 90 to crank shaft 91 to cause the desired reciprocal movement of the volume knife. The drive transmission is designed so that rotation of the cam 37 will cause the volume knife 18 to move through a distance slightly more than the combined width of turrets 11 and 12.

Referring still to FIG. 5, the operating station 24 includes a forming plunger 25 which is mounted in a housing boss 95 for movement radially of the turret 11, the forming plunger 25 having a concave inner surface 96 complementary in shape to the concave outer surface 82 of the metering shoe 66. The forming plunger 25 has an actuating arm 97 connected to a bell crank 98, the latter being pivotally mounted on a housing member 99. A link 100 extends from bell crank 98 to a lever 101 which is pivotally mounted at 102 to the frame of the machine and has a cam follower 103 thereon in engagement with a cam track 104 of a cam 105 which is fixed to the main drive shaft 36. The cam 105 and the drive transmission are designed so that for every revolution of the drive shaft 36, the forming plunger 25 will be forced into a pocket 13 to form the fish therein into the shape of a can 23, the plunger then being retracted from the pocket so that the turret 11 may then rotate. A drive link 106 is also connected to the bell crank 98 and actuates a similar linkage to move the forming plunger 21 into and out of a pocket in the turret 12 in synchronism with movement of the forming plunger 25.

The lock plunger 28 is similarly mounted for movement radially of the turrets and is actuated by a similar drive transmission in response to rotation of a cam 107 on the main shaft 36. As the plunger 28 moves inwardly, the tapered sides 108 and 109 engage the slots 81 of both turrets, centering the turrets and locking them both against rotation.

Referring now to FIGS. 5 and 6, the divider knife 19 is pivotally mounted on a shaft 110 to a housing member 111 for movement in a plane between the turrets and normal to the axis of the turrets, between the extreme positions shown in FIGS. 5 and 6, the housing wall being slotted at 112 to allow such movement. The face **12*a* of the turret 12 is cut away outwardly from the shoulder 12*b* thereon, and the adjacent face of the turret 11 is similarly cut away to allow the divider knife 19 to move therebetween. The face 66*a* of the metering shoes 66 are similarly cut away outwardly from the shoulders 66*b* thereof so that the shoes 66 can be both flush with the turret faces and provide room for the blade of the knife 19 to move therebetween. The divider knife 19 is actuated by rotation of a cam 113 on the main shaft 36, movement to the knife being imparted by the action of the pivotally mounted cam follower lever 114 and link 115**.

A dead plate 116, shaped the same as the divider knife 19, is also mounted on the shaft 110 for pivotal movement in unison with the knife 19. The inner side of the housing end plate 59 is cut away to allow the dead plate to move between the end plate 59 and the adjacent face of turret 11.

Figure 7:
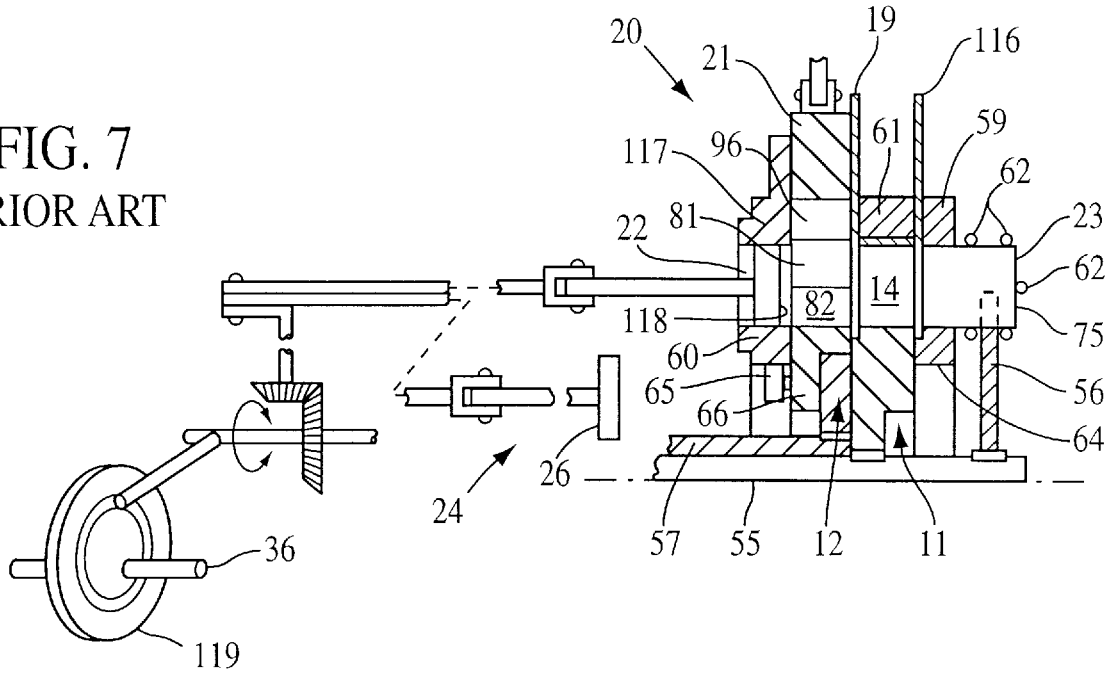
FIG. 7 PRIOR ART
FIG. 7 is a sectional view, taken on line 7—7 of FIG. 3, illustrating one of the knock-out plungers and, schematically the operating mechanisms for the knock-out plungers.

As may be seen from FIG. 7, the knock-out plunger 22 at the operating station 20 is mounted in a guide collar 117 on the housing plate 60 for reciprocal movement in a direction parallel to the axis of the turrets. The forward face 118 of the plunger 22 has a diameter complementary to the surface 82 of the shoe 66 and the surface 96 of the forming plunger 25. A cam 119 on the main shaft 36 with linkage and gearing is designed to move the knock-out plunger 22 through a stroke slightly more than the combined thickness of the turrets and the housing wall 59. As illustrated schematically, the same cam 119 will reciprocate the knock-out plunger 26.

Figure 9:
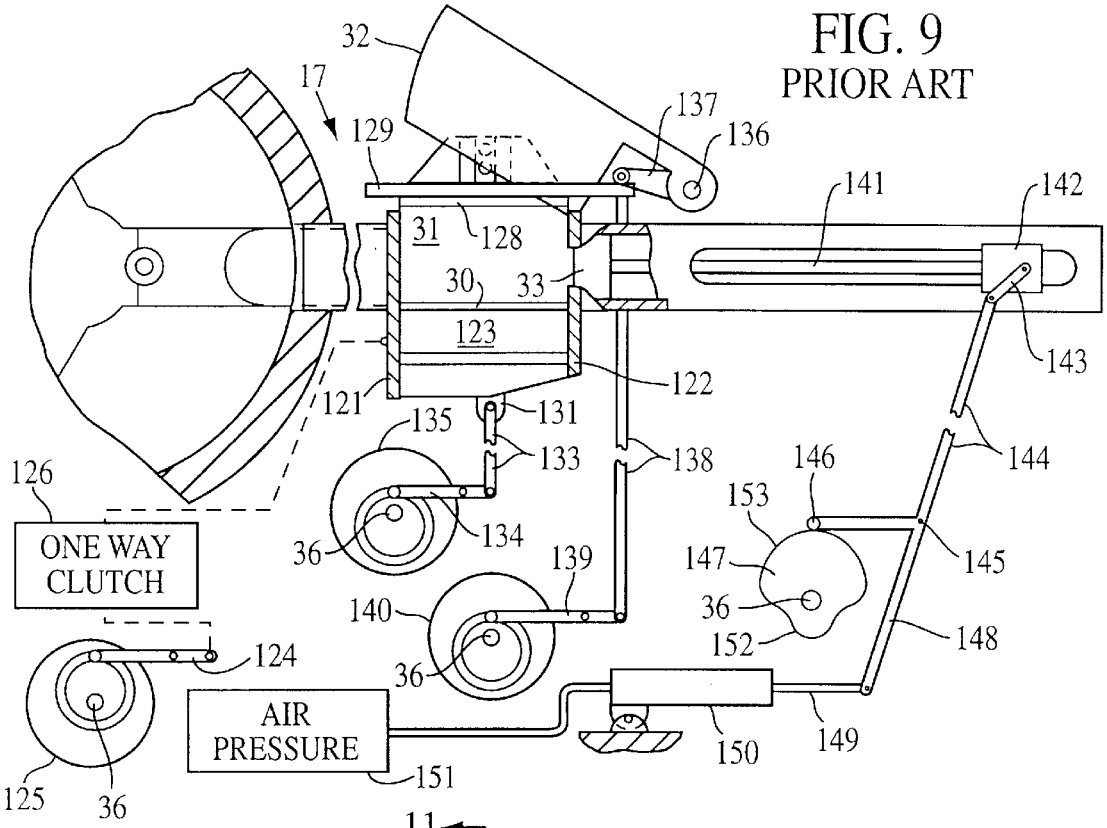
FIG. 9 PRIOR ART
FIG. 9 is an elevational view partly in section of the fish feed chute, conveyor, tamper, loin knife, ram and, schematically, the operating mechanism therefor.
Figure 10:
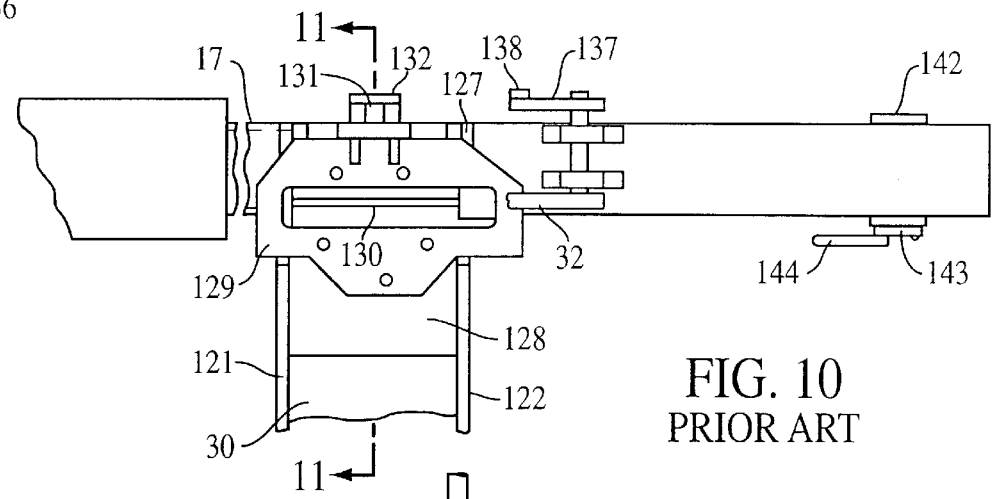
FIG. 10 PRIOR ART
FIG. 10 is a plan view of the apparatus shown in FIG. 9.
Figure 11:
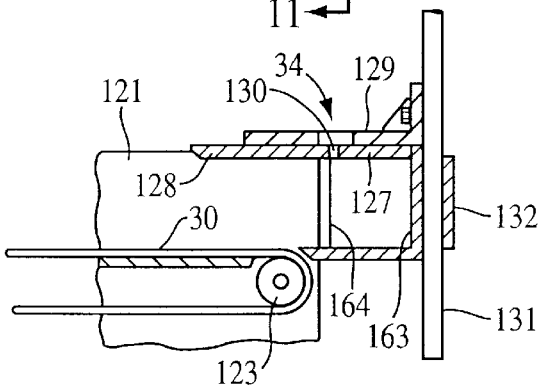
FIG.11 PRIOR ART
FIG. 11 is a sectional view taken on line 11—11 of FIG. 10.

Turning now to FIGS. 9–11, the conveyor belt 30 is disposed between vertically extending side plates 121 and 122 and trained around drive roller 123 so that the upper flight of the conveyor belt 30 is adjacent the side entrance 31 of the feed chute 17. The drive roller 123 is periodically rotated in a direction to advance the belt 30, in response to motion of a cam follower lever 124. The lever 124 is driven by a cam 125. This motion is transmitted to the belt 30 through one-way clutch 126.

The horizontal tamper 34 is spaced vertically above the bottom of the side entrance 31 and comprises a first portion 127 extending transversely of the entrance and forming the top of the feed chute 17 adjacent the side entrance 31 and a second portion 128 extending transversely of and outwardly from the feed chute to overlie the conveyor belt 30. The two portions are secured together for unitary movement by a yoke 129, the two portions are horizontally spaced to leave a slot 130 therebetween. The yoke 129 is secured to a vertical post 131 which is confined for vertical movement in a sleeve 132 and is connected by a link 133 to a cam follower lever 134. Rotation of the cam 135 will cause the tamper 34 to move up and down once for each revolution of the main shaft 36.

The loin knife 32 is fixed to a shaft 136 for pivotal movement down through the slot 130 and across the side entrance 31 of the feed chute. A crank arm 137 is also fixed to the shaft 136 and is connected by a link 138 to a cam follower lever 139 for actuation by a cam 140 on shaft 36.

The ram 33 is connected by a rod 141 to a slide block 142. A link 143 pivotally extends between the slide block 142 and one end of a bell crank 144, the latter being pivotally mounted on the frame at 145 and having a cam follower roller 146 in engagement with the face of a cam 147. The bell crank 144 has an extension arm 148 connected to piston rod 149 of a pneumatic cylinder 150, the cylinder being supplied with air pressure from a constant pressure source 151. As the cam 147 rotates to a position wherein its recessed face 152 is adjacent the cam follower roller 146, the bell crank 144 will rotate in a counterclockwise direction, under the force of the air pressure in the cylinder 150, to move the piston 33 to the left. Since the air in the cylinder 150 is maintained at a constant pressure, the ram 33 will exert a constant force on the fish in the feed chute regardless of the length of the stroke of the ram 33. Continued rotation of the cam 147 will bring its outer face 153 into engagement with the roller 146, pivoting the crank 144 in a clockwise direction to retract the ram to the position illustrated in FIG. 9.

As seen in FIGS. 5 and 6, the opposed inner surfaces 161 and 162 of the top and bottom walls of the feed chute 17 are tapered to diverge slightly as they extend away from the side entrance 31 of the feed chute toward the turrets 11 nd 12. The opposed inner surfaces 163 and 164 of the side walls of the feed chute are similarly tapered as seen in FIG. 8. As a consequence, the rectangular cross section of the feed chute increases in size along the length thereof towards the turrets. The taper angle should be sufficiently great so as to result in a desired decrease in sticking while not being so great as to allow fish to extrude into the gap between the ram and chute.

For purposes of illustration, the main shaft 36, with the various operating cams thereon, has been shown in different physical locations relative to the operating parts of the machine, and simplified linkages have been shown connecting the cams to the operating mechanisms. In an actual machine the cams would rotate on a common axis in a single shaft 36 with conventional motion transmitting linkages being employed to produce the results described hereinabove. If desired, the main shaft 36 could comprise two or more parallel shafts, driven in unison by conventional gearing or chain drives so as to locate the various cams thereon in closer proximity to the elements which are to be driven thereby.

Figure 12:
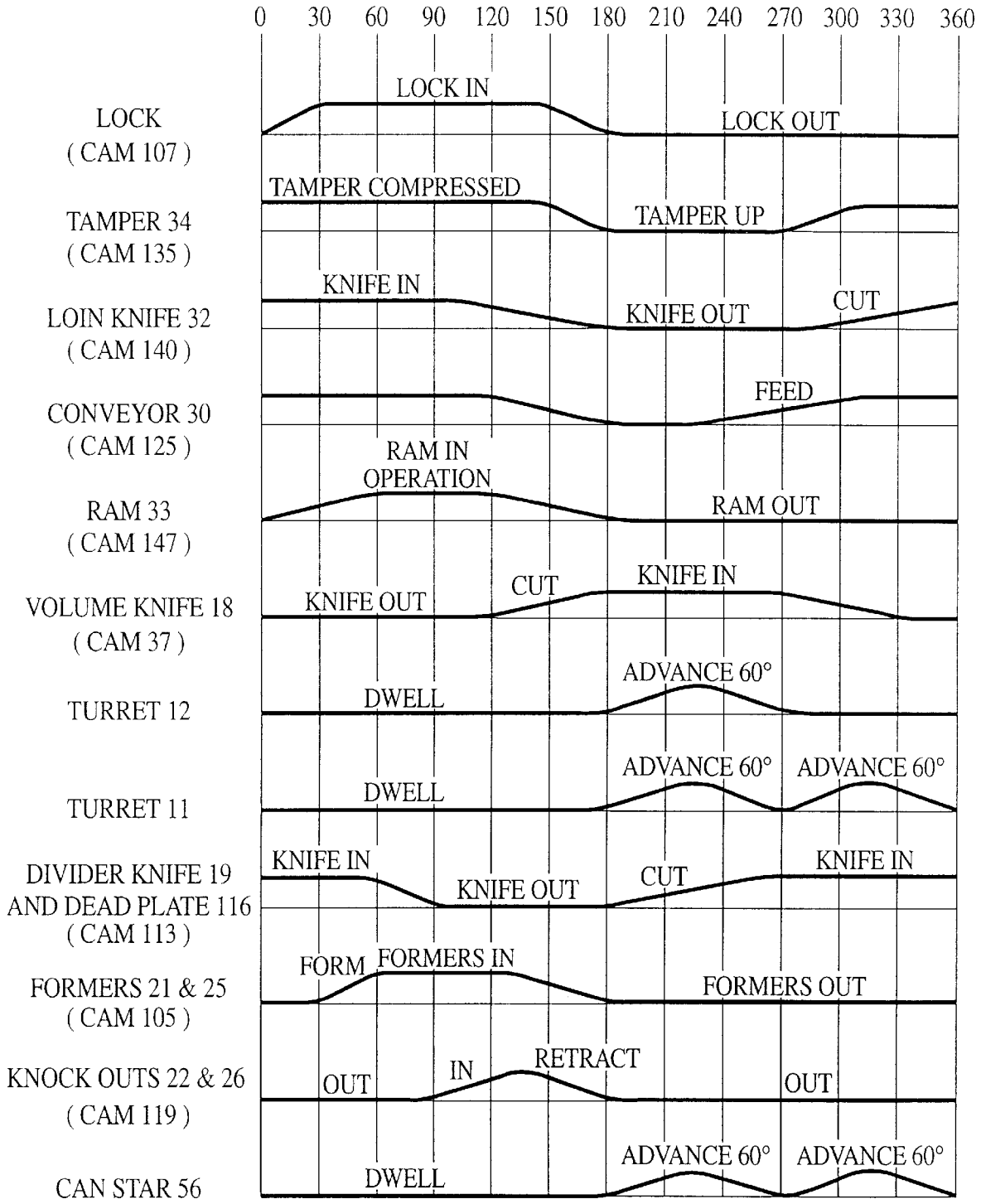
FIG. 12 PRIOR ART
FIG. 12 is a timing chart illustrating the sequence of operation of the various components of the machine.

The sequence of operations, independently of machine set up described below, can best be described by reference to FIG. 12, which shows the operations of the various components of the machine during a single revolution of the main drive shaft 36.

At the zero reference point, an empty pocket of each turret will have just been rotated to the feed station, these pockets and their side entrances being aligned to form a single combined pocket having an unobstructed common entrance thereinto. A new supply of fish loins will have been fed by conveyor 30 into the feed chute, the tamper 34 will be down and the loin knife will have descended, cutting the loins and closing the side entrances of the feed chute 17. If used, lock cam 107 will now actuate the turret lock, causing the lock plunger 28 to enter a pocket of each turret, indexing and locking the turrets against rotation.

The ram control cam 147 will now allow the ram 33 to be moved by the air pressure in the cylinder 150 so that the ram comes into engagement with the column of fish loins in the chute, the ram then forcing the loins down the chute and into the turret pockets with a force determined by the air pressure within the ram cylinder. Since the fish loins are essentially homogeneous in composition, the constant force thereon from the pneumatically operated ram is used to produce a uniform density and weight of fish in the turret pockets for each cycle of operation even though the initial amount of fish in the feed chute and the length of the stroke of the ram during filling may vary.

After the fish has been forced into the turret pockets, the volume knife cam 37 causes the volume knife 18 to enter between the pocket entrances and the feed chute to sever the column of fish loins and form a single slug of fish in the combined pockets, the slug having a weight and length twice that needed to fill a single can 23.

At this time, the turret lock plunger 28 will be retracted. the indexing drive units 42 and 43 will cause both turrets 11 and 12 to be advanced simultaneously through a 600 increment, so that both filled pockets are brought to the second station 20. During this time the cam 113 causes the divider knife 19 to descend between the pockets, the knife coming to rest at its full inward position at the end of the 60° rotation of the turrets. The relative movement of the knife and the rotating turret pockets provides a clean severing and division of the slug of fish in the pockets and forms a charge of fish in each pocket which has a length and weight equal to that required to fill a single can 23. At the same time, the dead plate 116 descends between the turret 11 and the end plate 59.

The indexing drive unit 42 then moves the turret 11 through another 60° advance, so that the filled pocket 13 thereof is brought to the third station 24.

During these successive periods of turret rotation, the tamper 34 will be raised and the loin knife 32 will be moved upwardly to open the side entrance into the feed chute. The conveyor 30 is actuated to advance a new charge of fish loins into the chute 17 and replenish the column of fish therein for the next cycle of operation. The tamper 34 will be lowered and the loin knife 32 will be swung down to sever the fish loins and again close the side of the chute.

At the start of a full cycle of operations as described above, a filled pocket of each turret will have been positioned at each of the second and third stations 20 and 24 as a result of the preceding cycle of operations of the machine.

The forming cam 105 actuates both forming plungers 21 and 25, causing them to enter into the side entrances of the filled pockets at the second and third stations and compress the fish into cylinders slightly smaller in diameter than the cans 23 into which the fish is to be packed. As the fish in the pocket 15 of the turret 12 is being formed, it is confined between the knockout plunger 22 and the divider knife 19 so that it is held from axial extrusion from the pocket. Similarly, the fish in the pocket 13 of the turret 11 is confined between the divider knife 19 and the dead plate 116 for the same purpose. The divider knife 19 and the dead plate 116 are now retracted and the knockout cam 119 causes the two knockout plungers 22 and 26 to enter endwise into the pockets and force the compressed cylinders of fish into the waiting cans. The holes 14 in the turret 11 and the holes 75 in the end plate 59 are slightly larger than the compressed cylinder of fish so as not to impede movement of the fish from the forming pockets at the cans.

The knock-out plungers and forming shoes are now retraced from the turrets, so that the turrets may then be advanced. Since the can star 56 is connected to the turret 11 for rotation therewith, the can star will rotate 120°. On each 60° increment of rotation a filled can will be stripped therefrom and an empty can will be picked up thereby in readiness for the next full cycle of operation.

The operation of the tamper 34 ensures that the feed chute will be properly and rapidly filled in the short time allotted for such operation. The fish loins will be piled on the conveyor belt ahead of the tamper to form a layer having a depth approximately equal to the height of the tamper portion 128 when in the raised position, or somewhat in excess thereof. As the layer is advanced by the conveyor belt, the forward edge of the tamper portion 128, which is raised during such advance, will strike off the excess to level the layer and allow the fish layer to advance beneath the tamper. In the period of time between operations of the conveyor, the tamper portion 128 will be moved downwardly to precompress the fish loins on the conveyor before they reach the feed chute which ensures that there will be minimal voids in the layer as it approaches the feed chute. The tamper will then be raised before the next advance of the conveyor belt, so that the tamper portion 128 will again allow the loins to pass easily thereunder. At the same time, the tamper portion 127 is raised to enlarge the opening into the feed chute so that the forward edge of the fish layer can advance easily into the feed chute. The conveyor again stops and the tamper is moved downwardly so that both tamper portions again press downwardly on the layer. At this time, the loin knife 32 is actuated to sever the fish layer. The compression of the layer by the tamper facilitates a clean cut thereof by the knife.

Preferably the bottom surface of the tamper portion 127 is somewhat vertically above the bottom surface of the tamper portion 128 for two reasons. First, such disposition will prevent the layer from hanging up when it is advanced from beneath the tamper portion 128 to beneath the tamper portion 127. Secondly, the downward force on the fish loins in the chute will be less than the precompression force caused by the tamper portion 128 so that the loins, after severing, may be more easily moved by the ram 33. Also, when the tamper portion 127 is in its lowered position, the bottom surface of this tamper portion is slightly below the level of the top of the feed chute so that the severed portion of the loins may be moved by the ram 33 down the feed chute without hanging up.

Although three pockets on the turret 11 and six pockets on the turret 12 have been shown, it is to be realized that a lesser or greater number could be used. As, for example, the turret 11 could have two pockets and the turret 12 could have four pockets. In such case, in one cycle of operation, the turret 12 would be rotated 90° to a second station 20 while the turret 11 would be rotated 180° to a third station 24, such rotation providing for the necessary disalignment of the filled pockets while simultaneously bringing empty pockets to the feed station for filling. Or, the turret 11 could have four pockets and the turret 12 could have eight pockets. In one cycle of operation, the turret 12 would be rotated 45° while the turret 11 is rotated 90°, misaligning the filled pockets and bringing empty pockets to the feed station. Decreasing the number of pockets will add, however, to the time in the cycle required for turret rotation. Increasing the number of pockets will decrease the time required for rotation but the closer spacing of the operating stations will require more design effort to fit the operating parts closer together.

Turning then to the new design represented in FIGS. 13 through 33, the new design employs substantial detail from the design of FIGS. 1–12 with the exceptions presented in the following. Thus, the feed system, the split rotation after cutting with a pivoted or stationary knife, the ejection system and the can delivery system are basically as before.

Figure 13:
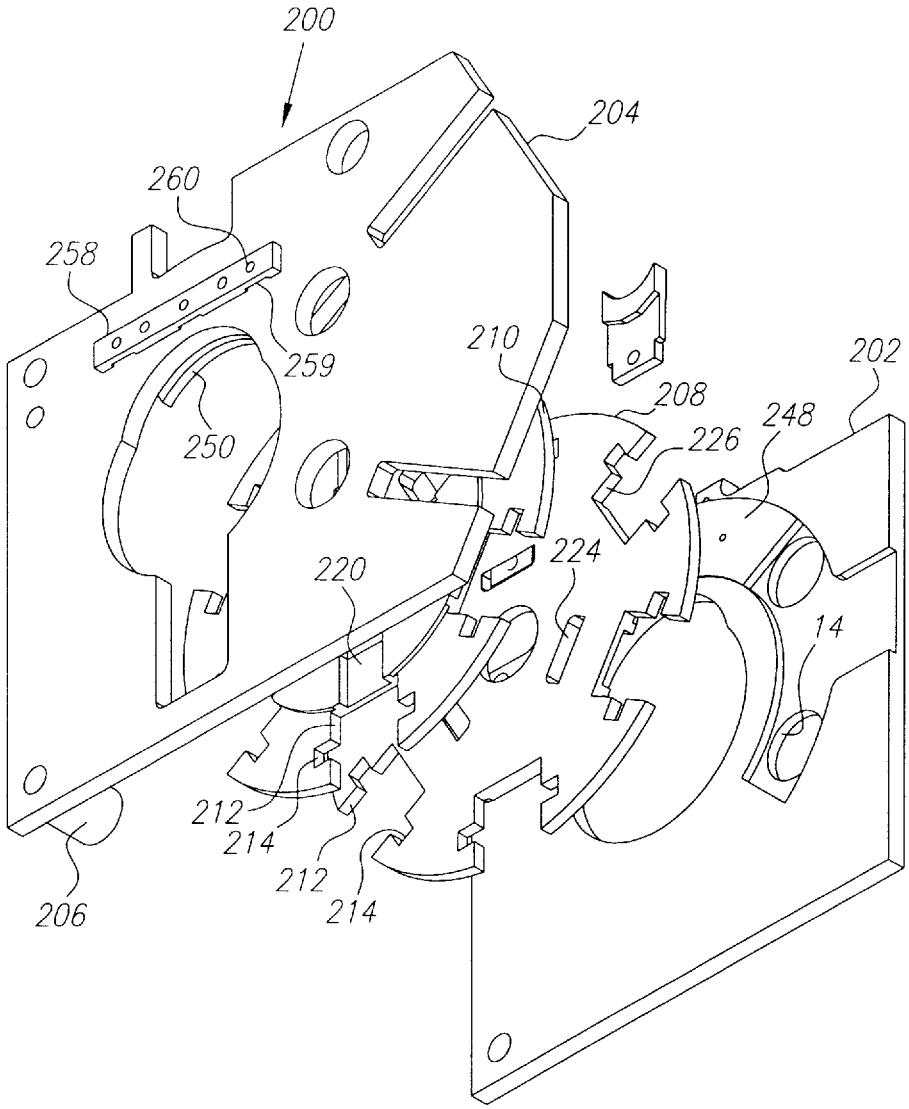
FIG. 13 is an exploded assembly in perspective of the turret mechanism.
Figure 14:
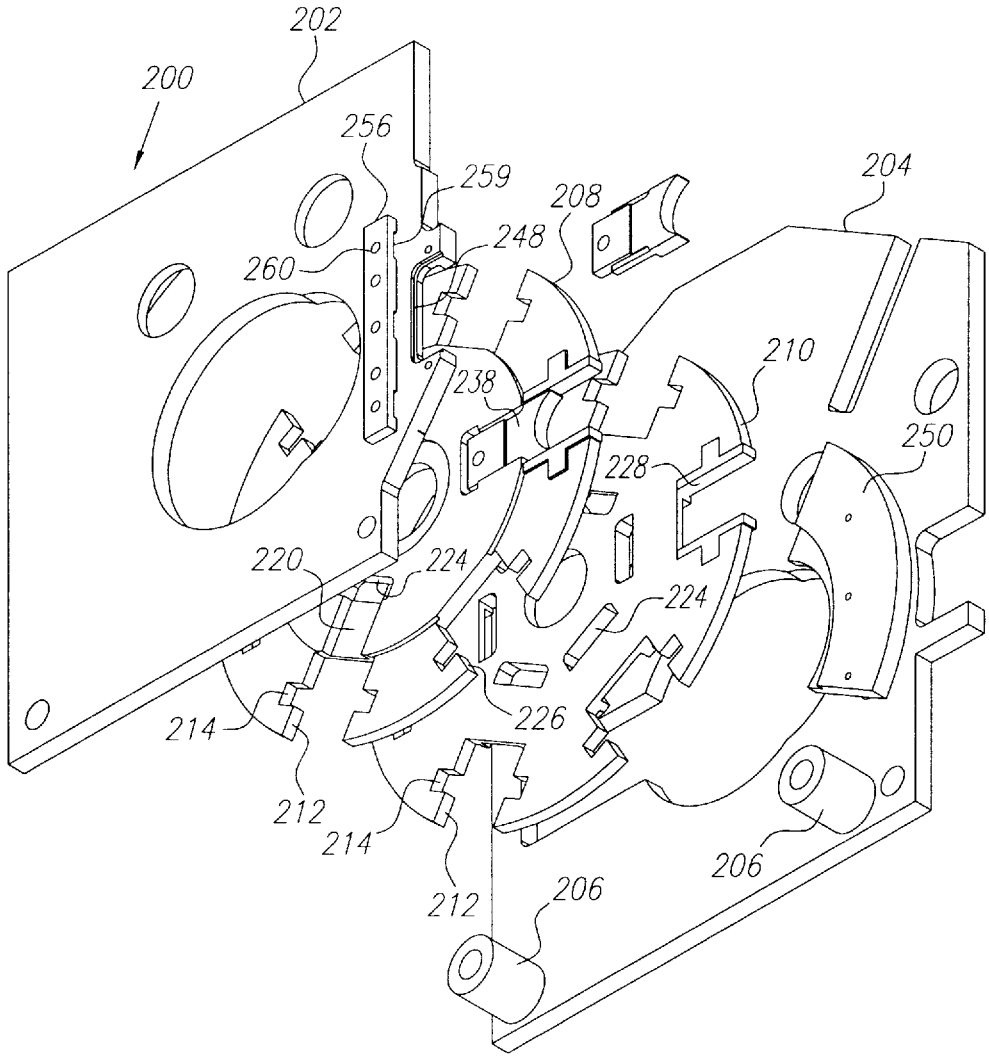
FIG. 14 is an exploded assembly in perspective of the turret mechanism of FIG. 13 viewed from the other side.

A housing, generally designated 200 is shown to include two opposed end plates 202 and 204. The end plates 202 and 204, similar to end plates 59 and 60 as seen in FIG. 2 and FIG. 4, are spaced apart as represented by spacers 206 as seen in FIGS. 13 and 14. These end plates 202 and 204 form a stationary part of the housing 200 about concentric shafts 55 and 57 such as seen in FIG. 2.

Figure 34:
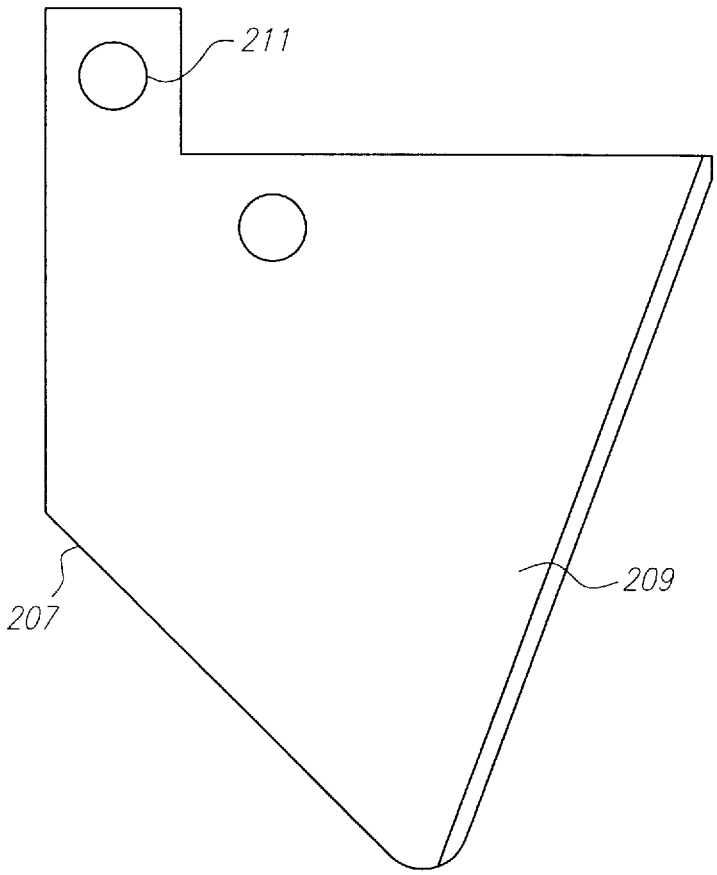
FIG. 34 is a side view of a stationary knife.

Two turret plates 208 and 210 are positioned within the space defined between the end plates 202 and 204. These turret plates 208 and 210 are fixed to the shafts 55 and 57, respectively. Thus, the turret plates 208 and 210 are fixed axially relative to the stationary housing 200 but are rotatably mounted within the housing 200 on the shafts. The spacers 206 are such that the opposed end plates 202 and 204 are displaced from the turret plates 208 and 210. The plates 208 and 210 are themselves either displaced slightly from one another or include an annular recess such that a pivotal divider knife 19 can enter therebetween to cut the product between turrets. The knife may alternatively be fixed. A fixed knife 207 is illustrated in FIG. 34 as including a blade 209 and anchor holes 211. The blade 209 extends between the turret plates 208 and 210 with the cutting edge in the path of turret forming pockets to cut the product between turrets. The thickness of each of the turret plates 208 and 210 is no greater than the minimum thickness contemplated for a product cake.

As with the embodiment described above, the turret plate 208 includes a plurality of product forming pockets 212. The two turret plates are best illustrated in FIGS. 15 through 20. The turret plate 208 has three product forming pockets 212 equiangularly spaced and extending radially inwardly from the periphery thereof. The pockets 212 extend axially fully across the turret plate 208. The pockets 212 have lateral cavities 214 on the sides. Threaded taps 216 extend inwardly from the periphery of the turret plate 208 to intersect the lateral cavities 214 for the purpose of accommodating set screws. In addition to the lateral cavities 214, channels 218 are located on the sides of the pockets 212 to either side of the lateral cavities 214.

Figure 17:
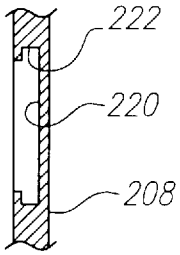
FIG. 17 is a cross-sectional side view taken along line 17—17 of FIG. 15.
Figure 15:
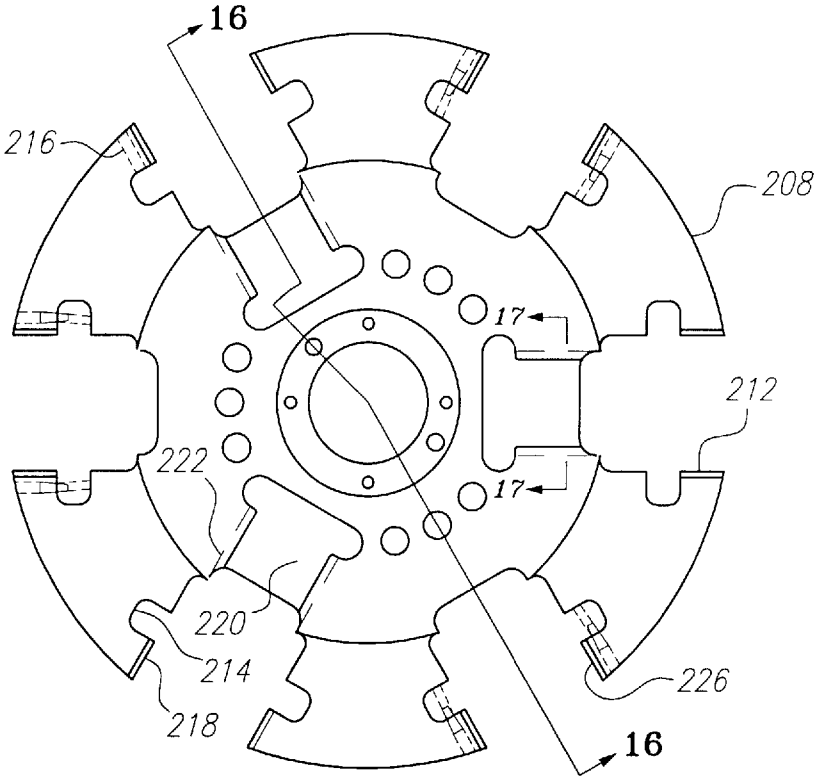
FIG. 15 is a plan view of the front turret plate.
Figure 16:
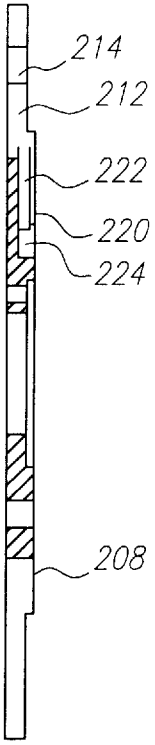
FIG. 16 is a cross-sectional side view taken along line 16—16 of FIG. 15.
Figure 19:
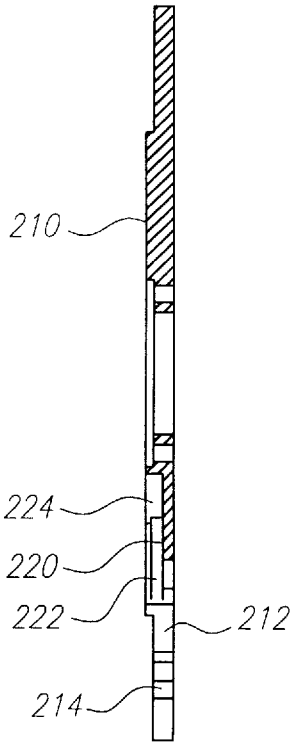
FIG. 19 is a cross-sectional side view taken along line 19—19 of FIG. 18.
Figure 18:
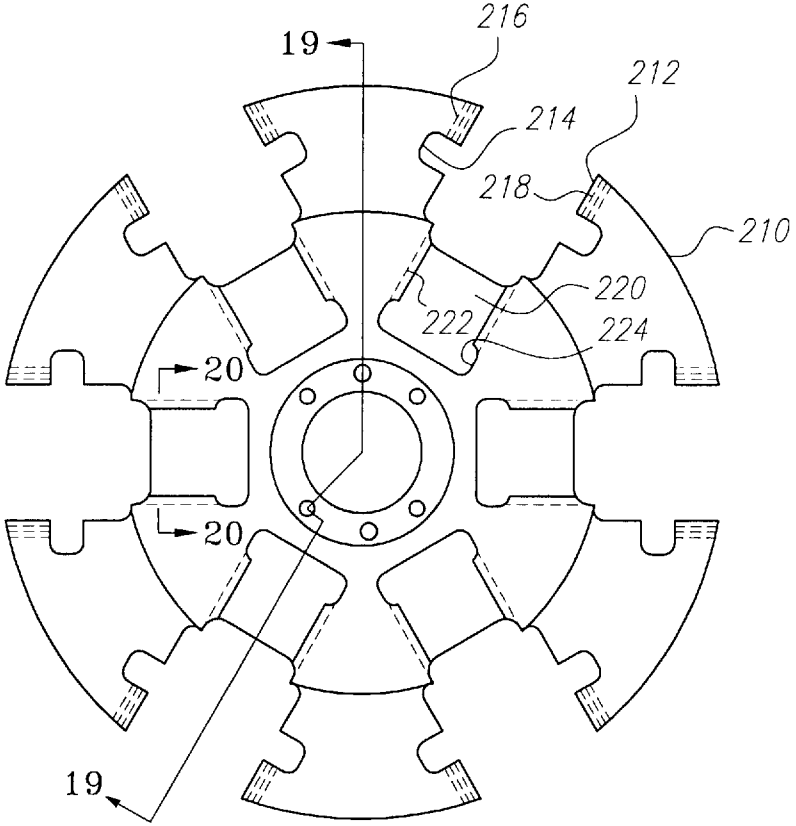
FIG. 18 is a plan view of the rear turret plate.
Figure 20:
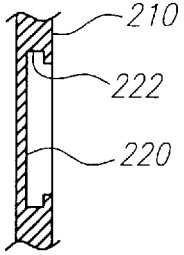
FIG. 20 is a cross-sectional side view taken along line 20—20 of FIG. 18.
Figure 22:
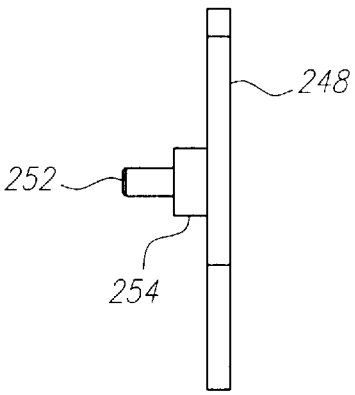
FIG. 22 is a side view of the plate insert of FIG. 21.
Figure 21:
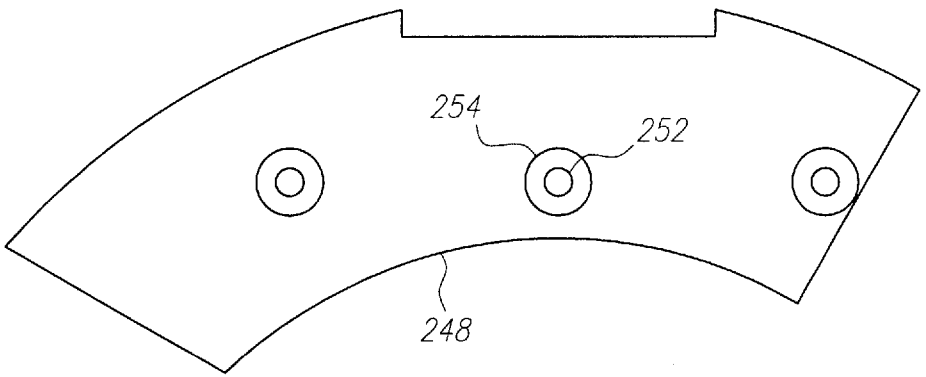
FIG. 21 is a plan view of a front plate insert.
Figure 24:
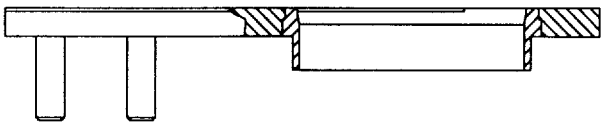
FIG. 24 is a side view of the plate insert of FIG. 23.
Figure 23:
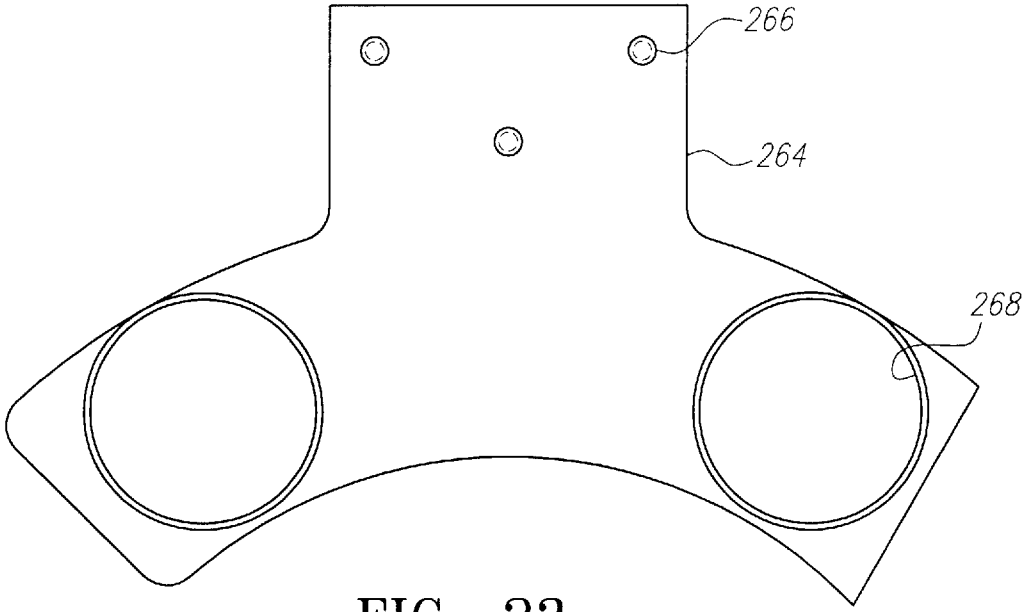
FIG. 23 is a plan view of a top plate insert.
Figure 25:
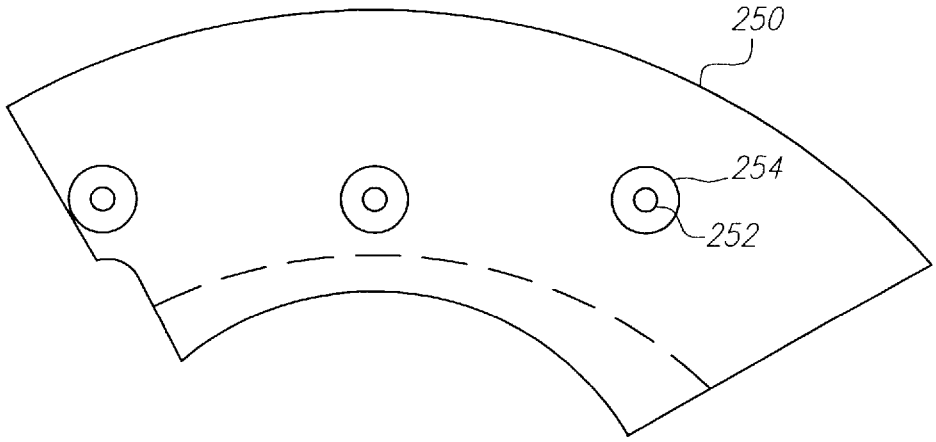
FIG. 25 is a plan view of another rear plate insert.
Figure 26:
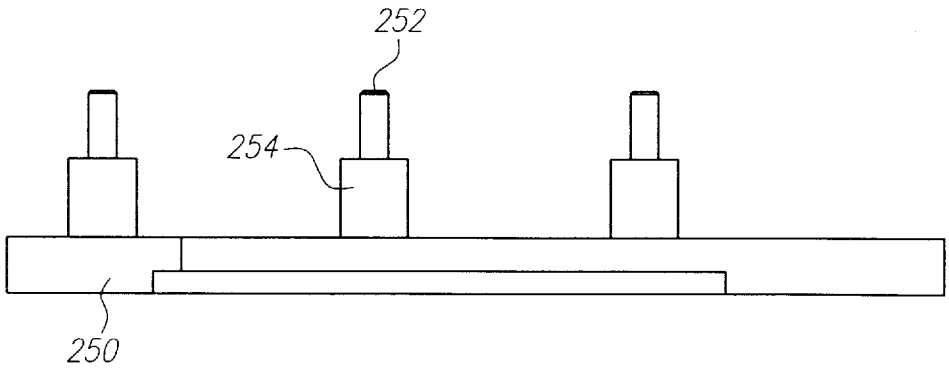
FIG. 26 is a side view of the plate insert of FIG. 25.

Forming shoe cavities 220 extend radially inwardly from the product forming pockets 212 but do not extend axially fully through the turret plate 208 on one side, as best seen in FIG. 17. The cavities 220 have channels 222 along the sides. The forming shoe cavities 220 extend inwardly to a relieved area 224. Openings 226 alternate between the product forming pockets 212 on the turret plate 208. These openings 226 provide for the passage of product through from the turret plate 210 as will be described below. The turret plate 208 further includes a hub for association with the shaft 55.

The turret plate 210 includes six product forming pockets 212 equiangularly spaced. Forming shoe cavities 220 are also provided with each of the six product forming pockets 212. A hub centered in the turret plate 210 associates with the shaft 57.

Figure 27:
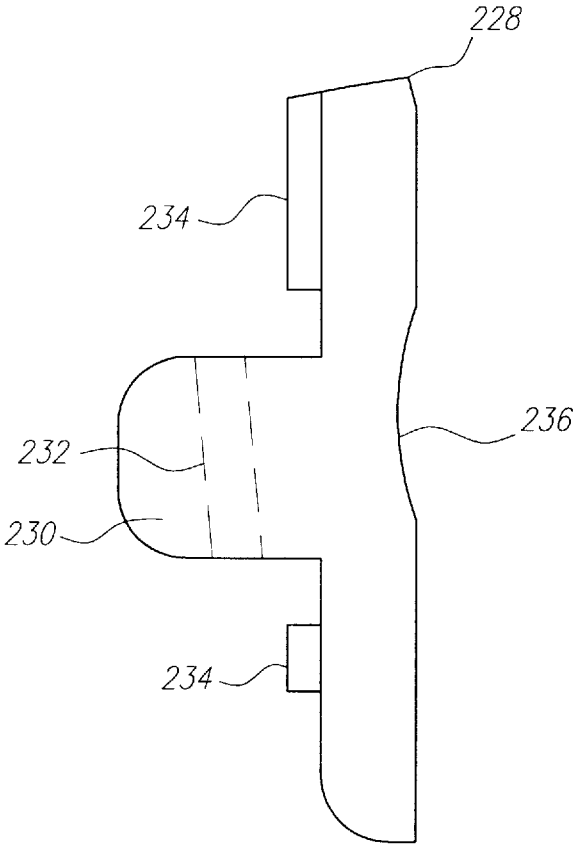
FIG. 27 is the plan view of a forming pocket guide.
Figure 28:
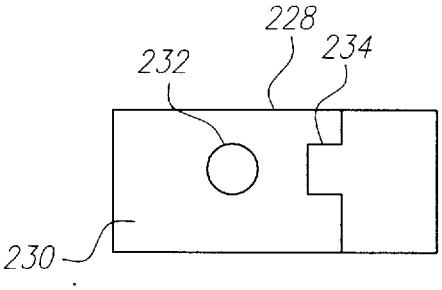
FIG. 28 is an end view of the guide of FIG. 27.

Forming pocket guides 228 are positioned and retained within the product forming pockets 212 in each of the turret plates 208 and 210. These forming pocket guides 228 are shown in place in FIG. 14. The guides 228 include laterally extending bosses 230 which interlock with the lateral cavities 214. Holes 232 align with the threaded taps 216 with the guides 228 in place to provide a further locking with set screws. Blocks 234 extending outwardly in the same direction as the bosses 230 fit within the channels 218 to further insure stable placement. A forming surface 236 is on the other side of each of the forming pocket guides 228 from the bosses 230 and blocks 234. This forming surface 236 on each of the guides 228 includes a slightly recessed profile as best seen in FIG. 27. These forming pocket guides 228 preferably do not extend axially from the thrust plates 208 and 210 toward the adjacent thrust plate. However, the guides 228 extend in the other direction axially beyond the thrust plates 208 and 210 to define the product forming pockets 212 beyond the thickness of the thrust plates 208 and 210.

Figure 29:
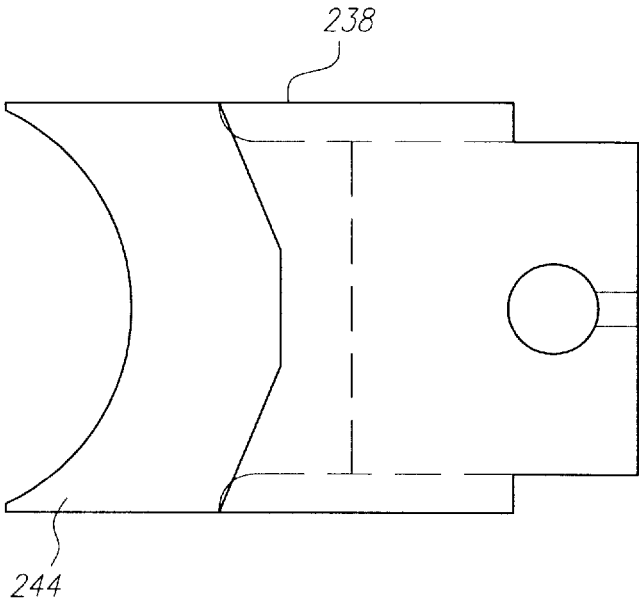
FIG. 29 is a plan view of an inner forming shoe.
Figure 30:
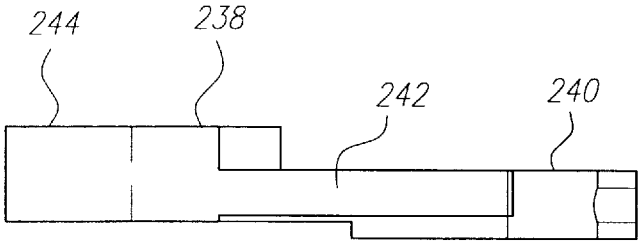
FIG. 30 is a side view of the shoe of FIG. 29.
Figure 31:
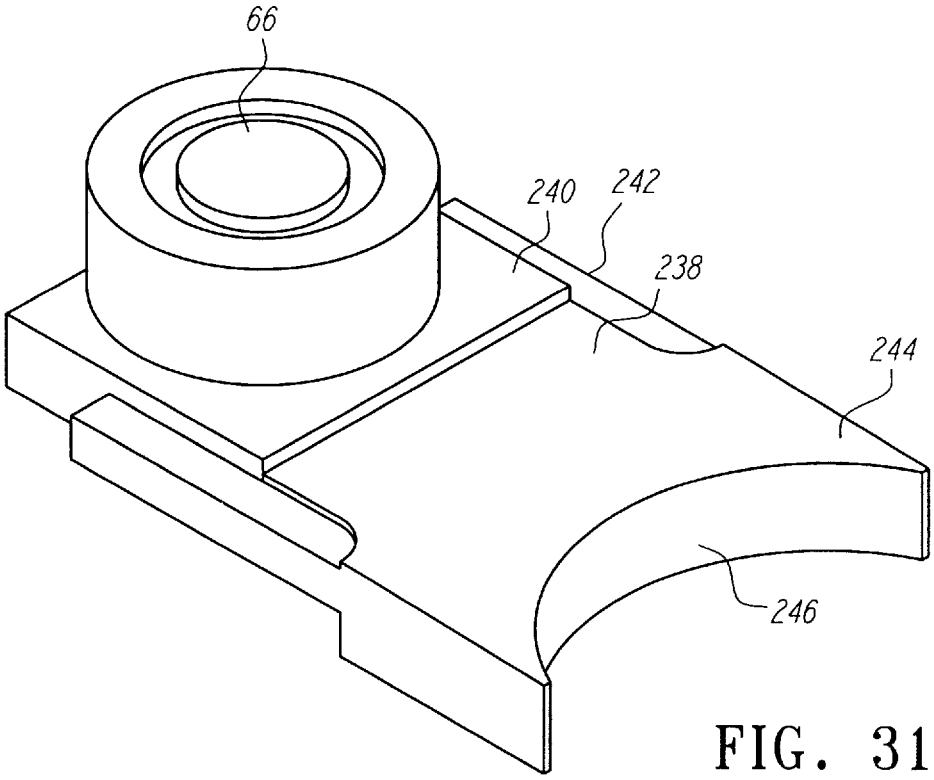
FIG. 31 is a perspective view of the inner forming shoe of FIG. 29 with a roller assembled therewith.
Figure 32:
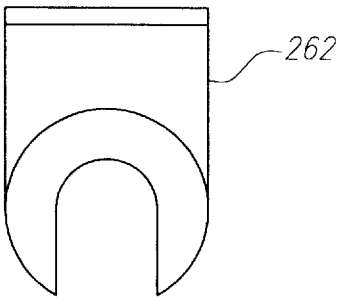
FIG. 32 is the plan view of a shim.
Figure 33:
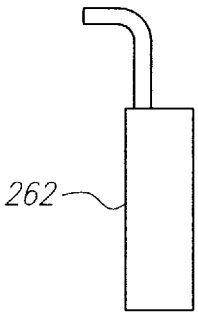
FIG. 33 is a side view of the shim of FIG. 29.

Forming shoes 238 slidably extend into the product forming pockets 212 between the forming surfaces 236 on the forming pocket guides 228. The forming shoes are best illustrated in FIGS. 29, 30 and 31. The forming shoes each include a rear guiding portion 240 which is located within the forming shoe cavities 220. The rear guiding portion 240 includes rails 242 on either side thereof to fit within the channels 222 located on the sides of the forming shoe cavities 220. Rollers 66 are rotatably mounted to the rear guiding portions 240 for driving the forming shoes 238 in radial directions as described above.

Each forming shoe 238 includes a head 244 which extends into one of the product forming pockets 212. The head includes a concave surface 246 designed to assist in the forming of the product cake along with the forming surfaces 236 on the forming pocket guides 228 and with the forming plunger 21 as employed from the prior mechanism. The heads 224, like the forming pocket guides 228, preferably do not extend beyond the associated turret plate toward the adjacent turret plate. The heads 244 do extend axially from the associated turret plate in the other direction to assist in forming the extent of the product forming pockets 212.

At the feed station 16, the product forming pockets 212 are to be fully contained. This prevents plastic flow of the product under the influence of the ram 33 at the feed station 16. To accomplish this, plate inserts 248 and 250 as shown in FIGS. 21, 22, 25 and 26 are positioned to either side of the turret plates 208 and 210, respectively, at the feed station 16. These plate inserts 248 and 250 are positioned immediately adjacent the forming pocket guides 228 and the heads 244 of the forming shoes 238 which extend outwardly from the turret plates 208 and 210.

The plate inserts 248 and 250 include threaded attachment elements or studs 252. These studs 252 extend from one side of each of the plate inserts 248 and 250. Positioned about the studs 252 are attachment spacers 254. These spacers may be slidably presented on the studs 252.

The opposed end plates 202 and 204 are displaced from the turret plates 208 and 210 as mentioned above. These end plates 202 and 204 receive the plate inserts 248 and 250 which are thereby fixed in place. Attachment bars 256 and 258 are bolted to the outside of each of the opposed end plates 202 and 204. These attachment bars 256 and 258 include spaced cavities 259 which overlie holes through the plates. The holes are of sufficient diameter to receive the attachment spacers 254. Holes 260 in the attachment bars 256 and 258 accommodate the threaded attachment elements 252. Nuts (not shown) may then be associated with the ends of the studs 252 extending from the attachment bars 256 and 258. The nuts draw the studs through the end plates 202 and 204 so that the attachment spacers 254 abut against the inside of the attachment bars 256 and 258 in the cavities 259. This snugly positions and fixes the plate inserts 248 and 250 in place. Additionally, shims 262 may be located within the cavities 259 about the studs 252 between the attachment bars 256 and 258 and the attachment spacers 254. The shims displace the plate inserts 248 and 250 inwardly.

To obtain appropriate closure around the product forming pockets 212 at the feed station 16, the thickness of the product cake is predetermined. Forming pockets guides 228 and forming shoes 238 are selected to match the required thickness of the product cake. As indicated above, the forming pocket guides 228 and the forming shoes 238 extend axially outwardly from the turret plates 202 and 204 to define this thickness. The appropriate combination of attachment spacers 254 and shims 262 are then chosen to locate the plate inserts 248 and 250 immediately adjacent the forming pocket guides 228 and the forming shoes 238. A plurality of shims 262 may be retained such that small adjustments can be easily made to insure proper fit between these elements.

To achieve a modification of the mechanism to accommodate a different cake thickness, the opposed end plates 202 and 204 may be partially or fully removed and replacement elements inserted. Alternatively, the attachment bars 256 and 258 may be removable such that the attachment spacers 254 may pass through the plates 202 and 204 for replacement. Space may also be made available in the nonoperative portion of the turret assembly for removal and replacement of the forming pocket guides 228 and the forming shoes 238.

A further plate insert 264 is located on the end plate 202. This plate insert 264 is located at the second station 28 for each of the turret plates 208 and 210 to bridge the gap between the turret plate 208 and the end plate 202. At this station, plungers 22 and 26 force the product cakes from each of the turrets through the holes 14 in the end plate 202 into cans 23. The plate insert 264 includes threaded attachment elements 266 for attachment to the plate 202 and holes 268 aligned with the holes 14 in the end plate 202. This plate insert 264 may be replaced to accommodate the extensions of the forming pocket guides 228 and the forming shoes 238 extending axially from the turret plate 208.

The accommodation of various pack thicknesses and densities may be accomplished with this equipment through the simple replacement of forming pocket guides 228, forming shoes 238 and forming plungers 21, adjustment to the ram 33 and repositioning of the attachment inserts 248 and 250 as well as possible replacement of the plate insert 264. The machine does not need to be substantially disassembled for the replacement of turret plates and housing elements. Difficulties associated with the fine adjustment of components necessary for proper canning operation are thus avoided.

Accordingly, an improved fish canning machine is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A canning apparatus comprising a housing;

a turret plate axially fixed and rotatably mounted relative to the housing and including a product forming pocket extending radially inwardly from the periphery of the turret plate and axially across the turret plate, the housing being spaced axially from the turret plate;

a plate insert fixable to the housing between and displaced from the housing and the turret plate, the plate insert being positionable in a range of axial positions between the housing and the turret plate.

2. The canning apparatus of claim 1 further comprising forming pocket guides fixable to the sides of the product forming pocket, the forming pocket guides extending axially across the turret plate and from the turret plate toward the housing, the plate insert and the forming pocket guides being immediately adjacent to define the axial extent of the forming pocket beyond the turret plate.

3. The canning apparatus of claim 2 further comprising a forming shoe slidably mountable to move radially in the product forming pocket between the forming pocket guides, the forming shoe extending axially across the turret plate and from the turret plate toward the housing, the plate insert and the forming shoe being immediately adjacent to define further the axial extent of the forming pocket beyond the turret plate.

4. The canning apparatus of claim 3, the turret plate further including a forming shoe cavity to receive the forming shoe, the forming shoe cavity being aligned and radially inwardly of the product forming cavity and having channels extending along the sides, the forming shoe having rails along the sides to slide within the channels in the forming shoe cavity.

5. The canning apparatus of claim 2 further comprising an attachment including threaded attachment elements fixed to the plate insert and extending from one side thereof and attachment spacers positioned about the threaded attachment elements, the threaded attachment elements being fixable to the housing.

6. The canning apparatus of claim 5, the housing including an end plate and an attachment bar fixed to the end plate, the end plate being parallel to the turret plate, the attachment bar having cavities adjacent the end plate, the attachment spacers being extendable into the cavities through the end plate and the threaded attachment elements being fixable to the attachment bar through the end plate.

7. The canning apparatus of claim 6 further comprising shims positionable in the cavities between the attachment bar and the attachment spacers.

8. The canning apparatus of claim 2, the product forming pocket including channels extending inwardly from the periphery of the turret plate on either side of the product forming pocket, the forming pocket guides having blocks extendable into the channels to lock the orientation of the forming pocket guides relative to the turret plate.

9. The canning apparatus of claim 8, the product forming pocket including lateral cavities, the forming pocket guides including bosses extendable into the lateral cavities to interlock the forming pocket guides with the turret plate to keep the forming pocket guides from sliding from the product forming pocket.

10. A canning apparatus comprising a housing;

a turret plate axially fixed and rotatably mounted relative to the housing and including a product forming pocket extending radially inwardly from the periphery of the turret plate and axially across the turret plate, the housing being spaced axially from the turret plate;

a forming shoe slidably mountable to move radially in the product forming pocket, the forming shoe extending axially across the turret plate and from the turret plate toward the housing;

a plate insert fixable to the housing between and displaced from the housing and the turret plate, the plate insert and the forming shoe being immediately adjacent to define the axial extent of the forming pocket beyond the turret plate.

11. The canning apparatus of claim 10 further comprising an attachment including threaded attachment elements fixed to the plate insert and extending from one side thereof and attachment spacers positioned about the threaded attachment elements, the threaded attachment elements being fixable to the housing.

12. The canning apparatus of claim 11, the housing including an end plate and an attachment bar fixed to the end plate, the end plate being parallel to the turret plate, the attachment bar having cavities adjacent the end plate, the attachment spacers being extendable into the cavities through the end plate and the threaded attachment elements being fixable to the attachment bar through the end plate.

13. The canning apparatus of claim 12 further comprising shims positionable in the cavities between the attachment bar and the attachment spacers.

14. A canning apparatus comprising a housing;

a turret plate axially fixed and rotatably mounted relative to the housing and including a product forming pocket extending radially inwardly from the periphery of the turret plate and axially across the turret plate, the housing being spaced axially from the turret plate;

a plate insert fixable to the housing between and displaced from the housing and the turret plate;

an attachment including threaded attachment elements fixed to the plate insert and extending from one side thereof and attachment spacers positioned about the threaded attachment elements, the housing including an end plate and an attachment bar fixed to the end plate, the end plate being parallel to the turret plate, the attachment bar having cavities adjacent the end plate, the attachment spacers being extendable into the cavities through the end plate and the threaded attachment elements being fixable to the attachment bar through the end plate.

15. The canning apparatus of claim 14 further comprising shims positionable in the cavities between the attachment bar and the attachment spacers.

16. A canning apparatus comprising a housing;

a turret plate axially fixed and rotatably mounted relative to the housing and including a product forming pocket extending radially inwardly from the periphery of the turret plate and axially across the turret plate, the housing being spaced axially from the turret plate;

forming pocket guides fixable to the sides of the product forming pocket, the forming pocket guides extending axially across the turret plate and from the turret plate toward the housing;

a plate insert fixable to the housing between and displaced from the housing and the turret plate, the plate insert and the forming pocket guides being immediately adjacent to define the axial extent of the forming pocket beyond the turret plate;

a forming shoe slidably mountable to move radially in the product forming pocket between the forming pocket guides, the forming shoe extending axially across the turret plate and from the turret plate toward the housing, the plate insert and the forming shoe being immediately adjacent to define further the axial extent of the forming pocket beyond the turret plate;

an attachment including threaded attachment elements fixed to the plate insert and extending from one side thereof and attachment spacers positioned about the threaded attachment elements, the housing including an end plate and an attachment bar fixed to the end plate, the end plate being parallel to the turret plate, the attachment bar having cavities adjacent the end plate, the attachment spacers being extendable into the cavities through the end plate and the threaded attachment elements being fixable to the attachment bar through the end plate;

shims positionable in the cavities between the attachment bar and the attachment spacers.

17. A canning apparatus comprising a housing;

a first turret plate axially fixed and rotatably mounted relative to the housing and including a first product forming pocket extending axially through the first turret plate and radially inwardly from the periphery of the first turret plate, the housing being spaced from the first turret plate;

a second turret plate axially fixed and rotatably mounted relative to the housing and including a second product forming pocket extending axially through the second turret plate and radially inwardly from the periphery of the second turret plate, the housing being spaced from the second turret plate;

a first plate insert axially adjustably fixable to the housing between and displaced from the housing and the first turret plate;

a second plate insert axially adjustably fixable to the housing between and displaced from the housing and the second turret plate.

18. The canning apparatus of claim 17 further comprising first forming pocket guides fixable to the sides of the first product forming pocket, the first forming pocket guides extending axially across the first turret plate and from the first turret plate toward the housing, the first plate insert and the first forming pocket guides being immediately adjacent to define the axial extent of the first forming pocket beyond the turret plate;

second forming pocket guides fixable to the sides of the second product forming pocket, the second forming pocket guides extending axially across the second turret plate and from the second turret plate toward the housing, the second plate insert and the second forming pocket guides being immediately adjacent to define the axial extent of the second forming pocket beyond the second turret plate.

19. The canning apparatus of claim 17 further comprising a first forming shoe slidably mountable to move radially in the first product forming pocket, the first forming shoe extending axially across the first turret plate and from the first turret plate toward the housing, the first plate insert and the first forming shoe being immediately adjacent to define the axial extent of the first forming pocket beyond the first turret plate;

a second forming shoe slidably mountable to move radially in the second product forming pocket, the second forming shoe extending axially across the second turret plate and from the second turret plate toward the housing, the second plate insert and the second forming shoe being immediately adjacent to define the axial extent of the second forming pocket beyond the second turret plate.

20. The canning apparatus of claim 17 further comprising a first attachment including first threaded attachment elements fixed to the first plate insert and extending from one side thereof and first attachment spacers positioned about the first threaded attachment elements, the housing including a first end plate and a first attachment bar fixed to the first end plate, the first end plate being parallel to the first turret plate, the first attachment bar having first cavities adjacent the first end plate, the first attachment spacers being extendable into the first cavities through the first end plate and the first threaded attachment elements being fixable to the first attachment bar through the first end plate;

a second attachment including second threaded attachment elements fixed to the second plate insert and extending from one side thereof and second attachment spacers positioned about the second threaded attachment elements, the housing including a second end plate and a second attachment bar fixed to the second end plate, the second end plate being parallel to the second turret plate, the second attachment bar having second cavities adjacent the second end plate, the second attachment spacers being extendable into the second cavities through the second end plate and the second threaded attachment elements being fixable to the second attachment bar through the second end plate.

21. The canning apparatus of claim 20 further comprising shims positionable in the first and second cavities between the first and second attachment bars and the first and second attachment spacers, respectively.

* * * * *